US009373940B2

(12) United States Patent
Takaoka et al.

(10) Patent No.: US 9,373,940 B2
(45) Date of Patent: Jun. 21, 2016

(54) SPARK PLUG

(71) Applicant: NGK SPARK PLUG CO., LTD., Nagoya-shi, Aichi (JP)

(72) Inventors: Katsuya Takaoka, Ichinomiya (JP); Kazuhiro Kurosawa, Komaki (JP); Kuniharu Tanaka, Komaki (JP); Haruki Yoshida, Tajimi (JP); Hirokazu Kurono, Nagoya (JP); Toshitaka Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/707,344

(22) Filed: May 8, 2015

(65) Prior Publication Data

US 2015/0325982 A1 Nov. 12, 2015

(30) Foreign Application Priority Data

May 12, 2014 (JP) ..... 2014-098322

(51) Int. Cl.

| | |
|---|---|
| ***H01T 13/20*** | (2006.01) |
| ***H01T 13/04*** | (2006.01) |
| ***H01T 13/41*** | (2006.01) |
| *H01T 13/05* | (2006.01) |

(52) U.S. Cl.

CPC ..... *H01T 13/04* (2013.01); *H01T 13/41* (2013.01); *H01T 13/05* (2013.01)

(58) Field of Classification Search

CPC ..... H01T 13/04; H01T 13/05; H01T 13/41
USPC ..... 313/118, 141, 143
See application file for complete search history.

(56) References Cited

U.S. PATENT DOCUMENTS

| | | | | |
|---|---|---|---|---|
| 2,896,120 A | | 7/1959 | Spittler | 315/85 |
| 4,456,900 A | * | 6/1984 | Toyoshima | H01T 13/41 315/41 |
| 4,751,430 A | * | 6/1988 | Muller | F02P 3/02 123/627 |

(Continued)

FOREIGN PATENT DOCUMENTS

| | | | |
|---|---|---|---|
| EP | 2224560 A2 | 9/2010 | H01T 13/38 |
| JP | S-62150681 A | 7/1987 | H01T 13/20 |

(Continued)

OTHER PUBLICATIONS

Extended European Search Report issued in corresponding European Patent Application No. 15166538.7, dated Aug. 4, 2015.

*Primary Examiner* — Donald Raleigh
*Assistant Examiner* — Kevin Quarterman
(74) *Attorney, Agent, or Firm* — Kusner & Jaffe

(57) ABSTRACT

A spark plug having an insulator with a through hole formed therein in a direction of an axis, a center electrode disposed in a front side of the through hole, a metal terminal disposed in a rear side of the through hole, an electrical connection part arranged in the through hole to establish electrical connection between the center electrode and the metal terminal and a metal shell holding therein the insulator. The electrical connection part has a conductor including a conductive material and at least one kind of Fe-containing oxide material. The Fe-containing oxide material contains at least FeO. The conductor satisfies a relationship of $0.06 \leq S1/(S1+S2) \leq 0.46$ where, in a cross section taken along the axis, S1 is an area occupied by the conductive material and S2 is an area occupied by the Fe-containing oxide material.

7 Claims, 3 Drawing Sheets

(56) References Cited

U.S. PATENT DOCUMENTS

| | | | | |
|---|---|---|---|---|
| 5,514,314 | A | 5/1996 | McDougal | 264/61 |
| 2006/0076865 | A1* | 4/2006 | Shibata | H01T 13/34 313/143 |
| 2006/0089024 | A1* | 4/2006 | Kraus | H01T 13/05 439/125 |
| 2010/0052497 | A1* | 3/2010 | Walker, Jr. | H01T 21/02 313/141 |

FOREIGN PATENT DOCUMENTS

| | | | | |
|---|---|---|---|---|
| JP | H02-284374 | A | 11/1990 | H01T 13/40 |
| JP | 2011-159475 | A | 8/2011 | H01T 13/20 |

* cited by examiner

SPARK PLUG

RELATED APPLICATION

This application claims priority from Japanese Patent Application No. 2014-098322, filed with the Japanese Patent Office on May 12, 2014, the entire content of which is hereby incorporated by reference.

FIELD OF THE INVENTION

The present invention relates to a spark plug.

BACKGROUND OF THE INVENTION

Hereinafter, the term "front" refers to a spark discharge side with respect to the direction of an axis of the spark plug; and the term "rear" refers to a side opposite the front side.

A spark plug for an internal combustion engine generally includes a cylindrical metal shell, a cylindrical insulator formed with a through hole and arranged in the metal shell, a center electrode disposed in a front side of the through hole, a metal terminal disposed in a rear side of the through hole and a ground electrode joined at a base end portion thereof to a front end face of the metal shell and bent so as to define a spark discharge gap between a distal end portion of the ground electrode and a front end portion of the center electrode. It is known, as a technique to prevent radio noise caused by engine operation, to provide a resistor between the center electrode and the metal terminal within the through hole of the insulator.

In recent years, there is a demand to increase the discharge voltage of the spark plug for high output performance of the internal combustion engine. However, the increase of the discharge voltage leads to an increase in high-frequency noise that can affect a vehicle electronic control system. It is thus demanded to suppress the occurrence of high-frequency noise during spark discharge of the spark plug.

There has been proposed various techniques to suppress such high-frequency noise. For example, Japanese Laid-Open Patent Publication No. 2011-159475 proposes the arrangement of a cylindrical ferrite body as a noise suppression member around the resistor in the spark plug. Japanese Laid-Open Patent Publication No. H02-284374 proposes the arrangement of a wound wire in the spark plug.

SUMMARY OF THE INVENTION

The present inventors have found, as a result of extensive researches, that the spark plug has room for improvement in the material and structure of an electrical connection part between the center electrode and the metal terminal within the through hole of the insulator for the purpose of effective suppression of high-frequency noise.

The present invention has been made in view of the above circumstances and can be embodied by the following configurations.

Configuration [1]

In accordance with a first aspect of the present invention, there is provided a spark plug comprising:

an insulator having a through hole formed therein in a direction of an axis;

a center electrode disposed in a front side of the through hole;

a metal terminal disposed in a rear side of the through hole;

an electrical connection part arranged in the through hole to establish electrical connection between the center electrode and the metal terminal; and a metal shell holding therein the insulator, wherein the electrical connection part has a conductor including a conductive material and at least one kind of Fe-containing oxide material;

wherein the Fe-containing oxide material contains at least FeO; and wherein the conductor satisfies a relationship of $0.06 \leq S1/(S1+S2) \leq 0.46$ where, in a cross section taken along the axis, S1 is an area occupied by the conductive material; and S2 is an area occupied by the Fe-containing oxide material.

It is possible in configuration [1] to effectively suppress the occurrence of high-frequency noise by the noise suppression function of the Fe-containing oxide material. In particular, FeO is relatively stable at high temperatures so that it is possible in the presence of FeO to prevent degradation of the Fe-containing oxide material over time. It is further possible to prevent the resistance of the conductor from becoming too high by controlling the area ratio S1/(S1+S2) to be 0.06 or greater and, at the same time, possible to secure the sufficient noise suppression function of the Fe-containing oxide material by controlling the area ratio S1/(S1+S2) to be 0.46 or smaller.

Configuration [2]

In accordance with a second aspect of the present invention, there is provided a spark plug according to configuration [1], wherein the conductor further includes an alkaline-containing phase that contains an oxide of an alkali metal and an oxide of at least one kind of element selected from the group consisting of Si, B and P.

In configuration [2], the oxide of Si, B and/or P forms a glass. As the viscosity and melting point of the glass can be lowered by the addition of the metal element, the glass becomes easier to fill in voids of the conductor for close packing of the conductor. It is thus possible to effectively suppress the occurrence of high-frequency noise.

Configuration [3]

In accordance with a third aspect of the present invention, there is provided a spark plug according to configuration [2], wherein the alkali metal is contained in an amount of 0.5 to 6.5 wt % in terms of oxide based on the conductor.

It is possible in configuration [3] to not only reduce the possibility that the Fe-containing oxide material becomes degraded upon reaction with the alkali metal, but also prevent the occurrence of cracking in the conductor (in particular, alkaline-containing phase).

Configuration [4]

In accordance with a fourth aspect of the present invention, there is provided a spark plug according to any configurations [1] to [3], wherein the Fe-containing oxide material further contains a ferrite.

It is possible in configuration [4] to effectively improve the noise suppression function of the Fe-containing oxide material as the ferrite works well as an inductance component.

Configuration [5]

In accordance with a fifth aspect of the present invention, there is provided a spark plug according to configuration [4], wherein the FeO is contained in an amount of 0.8 to 5.2 wt % based on the Fe-containing oxide material.

It is possible in configuration [5] to effectively prevent degradation of the Fe-containing oxide material over time, while securing the sufficient noise suppression function of the ferrite, by controlling the FeO content to be within the range of 0.8 to 5.2 wt %.

Configuration [6]

In accordance with a sixth aspect of the present invention, there is provided a spark plug according to any configurations [1] to [5], wherein the conductor further includes Cu in an amount of 0.03 to 5.4 wt % in terms of divalent Cu oxide.

It is possible in configuration [6] to effectively improve the high-frequency noise suppression effects and durability of the electrical connection part by the addition of Cu to the conductor.

Configuration [7]

In accordance with a seventh aspect of the present invention, there is provided a spark plug according to any one of configurations [1] to [6], wherein the electrical connection part has a resistor including a conductive material and a glass material, a first conductive seal layer located adjacent to the center electrode and a second conductive seal layer located adjacent to the metal terminal;

wherein the conductor and the resistor are arranged between the first and second conductive seal layers; and wherein a resistance between the center electrode and the metal terminal is in a range of 3 to 20 kΩ.

It is possible in configuration [7] to further improve the high-frequency noise suppression effects of the electrical connection part as the resistor also performs the noise suppression function.

It is feasible to embody the present invention in various forms such as, not only a spark plug, but also an internal combustion engine with a spark plug, a vehicle having an internal combustion engine with a spark plug and a manufacturing method of a spark plug.

The other objects and features of the present invention will also become understood from the following description.

DETAILED DESCRIPTION OF THE PREFERRED EMBODIMENTS

The present invention will be described below with reference to the drawings.

A. Overall Structure of Spark Plug

Figure 1:
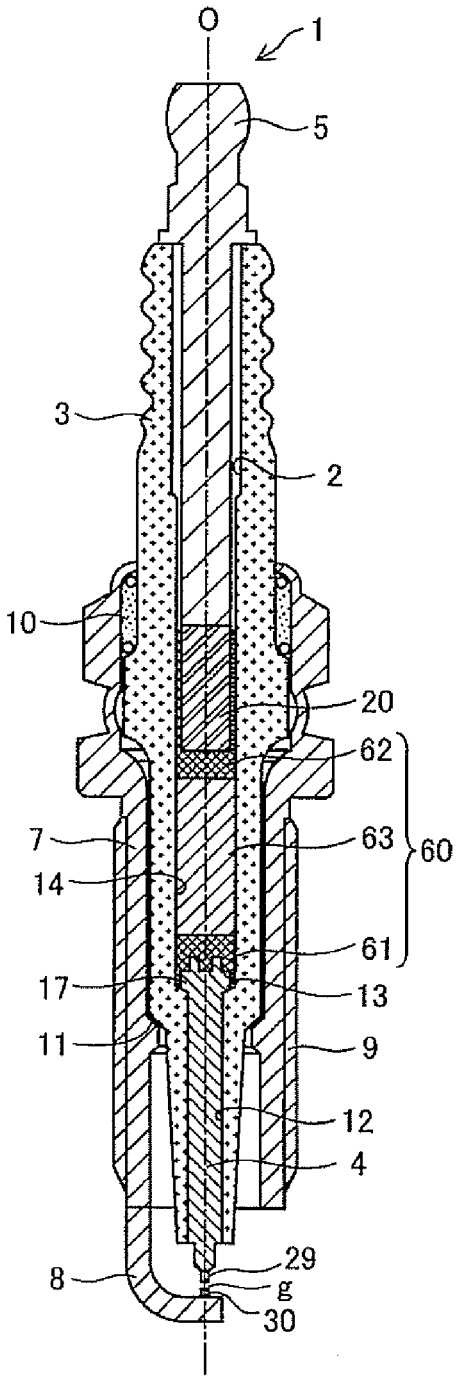
FIG. 1 is a section view of a spark plug according to a first embodiment of the present invention.

FIG. 1 is a schematic view of a spark plug 1 for an internal combustion engine according to a first embodiment of the present invention. As shown in FIG. 1, the spark plug 100 includes an insulator 3 having a through hole 2 formed in the direction of an axis O, a center electrode 4 disposed in a front side of the through hole 2, a metal terminal 5 disposed in a rear side of the through hole 2, an electrical connection part 60 arranged between the center electrode 4 and the metal terminal 5 within the through hole 2 for electrical connection of the center electrode 4 to the metal terminal 5, a metal shell 7 holding therein the insulator 3 and a ground electrode 8 having a base end portion joined to the metal shell 7 and a distal end portion facing a front end face of the center electrode 4 with some space left therebetween.

The metal shell 7 is substantially cylindrical in shape to surround and hold therein an outer circumference of the insulator 3. A thread portion 8 is formed on an outer circumferential surface of a front end part of the metal shell 7 such that the spark plug 1 can be mounted to a cylinder head (not shown) of the internal combustion engine by means of the thread portion 8.

The insulator 3 is held in an inner circumferential part of the metal shell 7 via a talc powder 10 and a packing 11, with a front end portion of the insulator 3 protruding from a front end of the metal shell 7. The through hole 2 of the insulator 3 includes a front cylindrical region 12 made small in diameter and a middle cylindrical region 14 located in rear of the front cylindrical region 12 and made larger in inner diameter than the front cylindrical region 12. A tapered step portion 13 is formed on a part of the insulator 3 between the front cylindrical region 12 and the middle cylindrical region 14 so as to increase in diameter toward the rear.

It is preferable that the insulator 3 is made of a material having mechanical strength, thermal strength, electrical strength etc. As such an insulator material, there can be used an alumina-based sintered ceramic material.

The center electrode 4 is substantially rod-shaped. A large-diameter flanged portion 17 is formed on a rear end part of the center electrode 4. The center electrode 4 is held in the front cylindrical region 12 of the through hole 2 by engagement of the flanged portion 17 on the step portion 13, with a front end portion of the center electrode 4 protruding from a front end of the insulator 3, while being kept insulated from the metal shell 7.

It is preferable that the center electrode 4 is made of a material having thermal conductivity, mechanical strength etc. As such an electrode material, there can be used a Ni (nickel) alloy material such as Inconel (trade name). A core of high thermal conducting metal material, such as Cu (copper) or Ag (silver), may be embedded in the center of the center electrode 4.

The ground electrode 8 is bent at a middle portion thereof such that, while the base end portion of the ground electrode 8 is joined to the front end face of the metal shell 7, the distal end portion of the ground electrode 8 faces the front end face of the center electrode 4.

Tips 29 and 30 of noble metal, such as Pt (platinum) alloy or Ir (iridium) alloy, are disposed on the front end face of the center electrode 4 and the distal end portion of the ground electrode 8, respectively, so as to define a spark discharge gap g therebetween. It is alternatively feasible to omit either one or both of these noble metal tips 29 and 30.

The metal terminal 5 is held in the middle cylindrical region 14 of the through hole 2 and connected to the electrical connection part 60 so as to apply a high voltage from an external device to the center electrode 4 through the electrical connection part 60 for the generation of spark discharge in the spark discharge gap g. In the first embodiment, a front end portion 20 of the metal terminal 5 is formed with projections and depressions. More specifically, an outer circumferential surface of the front end portion 20 of the metal terminal 5 is knurled so as to allow good contact between the metal terminal 5 and the electrical connection part 60 for firm fixing of the metal terminal 5 in the insulator 3. The metal terminal 5 can be made of low carbon steel with a metal plating of Ni etc.

The electrical connection part 60 is arranged in the though hole 2 and connected at both ends thereof to the center electrode 4 and the metal terminal 5 so as to establish electrical connection between the center electrode 4 and the metal terminal 5.

In the first embodiment, the electrical connection part 60 has a conductor 63 to suppress and prevent the occurrence of radio noise (electromagnetic noise). The electrical connection part 60 also has a first conductive seal layer 61 located between the conductor 63 and the center electrode 4 and a second conductive seal layer 62 located between the conductor 63 and the metal terminal 5 such that the center electrode 4 and the metal terminal 5 are sealed and fixed to the insulator 3 by these seal layers 61 and 62.

The first and second conductive seal layers 61 and 62 are formed by e.g. mixing a glass powder such as borosilicate soda glass with a metal powder such as Cu, Fe (iron) etc. and firing the resulting seal material power. In general, each of the first and second conductive seal layers 61 and 62 has a resistance of several hundred mΩ or lower.

The conductor 63 is formed using a conductive material and at least one kind of Fe-containing oxide material. More specifically, the conductor 63 is formed by mixing a powder of the conductive material (sometimes referred to as "conductive material powder") with a powder of the Fe-containing oxide material (sometimes referred to as "Fe-containing oxide material powder") and firing the resulting mixed powder such that the conductor 63 has a phase of the conductive material and a phase of the Fe-containing oxide material. By this conductor 63, it is possible to effectively suppress the occurrence of high-frequency noise during spark discharge of the spark plug.

The conductive material can be at least one kind selected from: alloys such as Sendust, Permalloy, Fe—Ni alloy, ferrosilicon, TiC (titanium carbide); WC (tungsten carbide); metals such as W (tungsten), Fe, Ni and Mo (molybdenum); carbon materials such as carbon black and carbon fiber. With the use of such a conductive material(s), the resistance of the conductor 63 can be prevented from becoming too high and can be controlled to an adequate value (e.g. about 100 to 500Ω).

The Fe-containing oxide material can be at least one kind selected from: FeO; $Fe_2O_3$; and various ferrites such as Mn—Zn ferrite and Ni—Zn ferrite. In the first embodiment, the Fe-containing oxide material contains at least FeO. As FeO is relatively stable at high temperatures, the presence of FeO enables to prevent degradation of the Fe-containing oxide material over time. In the case where $Fe_2O_3$ is contained in the Fe-containing oxide material, there is a tendency that $Fe_2O_3$ is reduced to FeO at high temperatures. This reduction reaction can however be prevented in the presence of FeO.

Further, the conductor 63 satisfies a relationship of $0.06 \leq S1/(S1+S2) \leq 0.46$ where, in a cross section of the conductor 63 observed along the axis O, S1 is an area occupied by the conductive material; and S2 is an area occupied by the Fe-containing oxide material in the first embodiment. By controlling the area ratio S1/(S1+S2) to be 0.06 or greater, the resistance of the conductor 63 can be prevented from becoming too high. The sufficient noise suppression function of the Fe-containing oxide material can be secured by controlling the area ratio S1/(S1+S2) to be 0.46 or smaller.

It is preferable that the Fe-containing oxide material contains a ferrite as the ferrite has ferromagnetism and works well as a inductance component to suppress high-frequency noise.

In the case where the ferrite is contained in the Fe-containing oxide material, the content of FeO in the Fe-containing oxide material is preferably 0.8 to 5.2 wt %. By controlling the FeO content to be 0.8 wt % or higher, the Fe-containing oxide material can be effectively prevented from degradation over time. The sufficient noise suppression function of the ferrite can be secured by controlling the FeO content to be 5.2 wt % or lower.

It is also preferable that the conductor 63 includes an alkaline-containing phase that contains an oxide of an alkali metal and an oxide of at least one kind of element selected from the group consisting of Si (silicon), B (boron) and P (phosphorus). As the alkali metal, there can be used Na (sodium), K (potassium), Li (lithium) or the like. The alkaline-containing phase is typically in the form of glass such as borosilicate soda glass (that is, the oxide of Si, B and/or P forms glass). To be more specific, the alkaline-containing phase is preferably formed by vitrification and recrystallization. It is herein noted that, in the present specification, the term "glass" has a wide meaning, including those obtained by recrystallization of glass component as mentioned above. By the addition of alkali metal, the glass can be lowered in viscosity and melting point and thereby becomes easier to fill in voids of the conductor 63. The conductor 63 can be thus closely packed and contribute to effective suppression of high-frequency noise.

The content of the alkali metal in the conductor 63 is preferably 0.5 to 6.5 wt % in terms of oxide. The alkali metal gradually reacts with the Fe-containing oxide material to form $LiFe_5O_8$, $LiFeO_2$, $Na_2Fe_2O_4$, $KFeO_2$, $KFe_{11}O_{17}$ etc. With the formation of such a compound, the Fe-containing oxide material becomes degraded so that the noise suppression function of the Fe-containing oxide material deteriorates over time. The possibility that the Fe-containing oxide material becomes degraded upon reaction with the alkali metal can be reduced by controlling the alkali metal content to be 6.5 wt % or lower. If the alkali metal is added in an excessively small amount, the glass does not melt during formation of the conductor 63 so that there may occur laminar cracking in the conductor 63. The occurrence of such cracking can be prevented by controlling the alkali metal content to be 0.5 wt % or higher.

The conductor 63 may further include 0.03 to 5.4 wt % of Cu in terms of divalent Cu oxide. The noise suppression effects and durability can be effectively improved by the addition of Cu. The sufficient effects of Cu addition may not be obtained if Cu is added in an amount of less than 0.03 wt %. On the contrary, the noise suppression effects may deteriorate if Cu is excessively added in an amount of more than 5.4 wt %.

Figure 2:
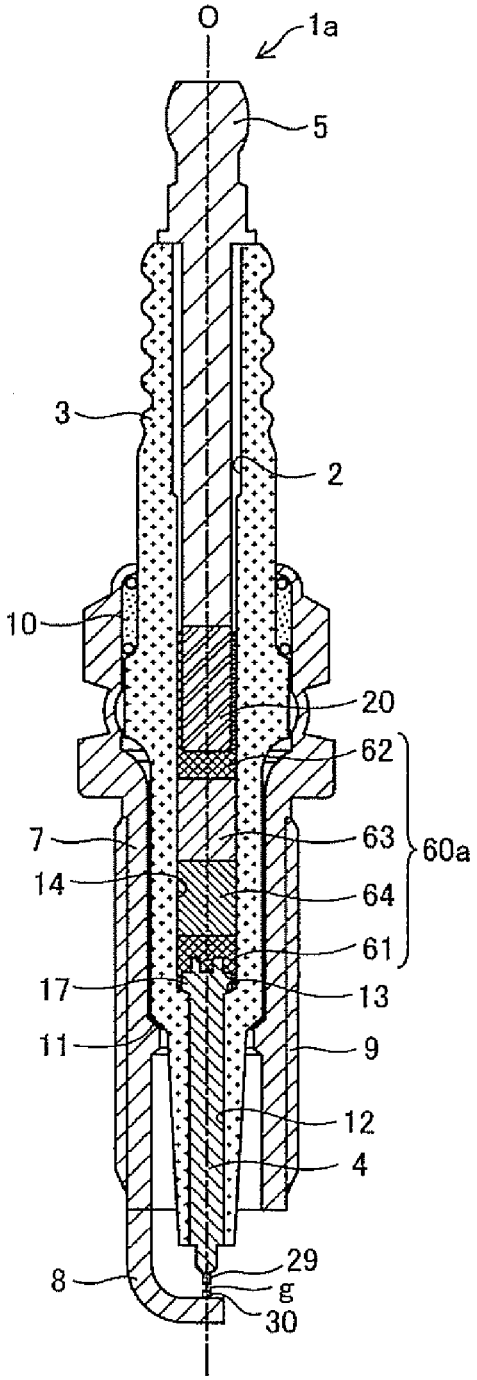
FIG. 2 is a section view of a spark plug according to a second embodiment of the present invention.

FIG. 2 is a schematic view of a spark plug 1*a* for an internal combustion engine according to a second embodiment of the present invention. The spark plug 1*a* of the second embodiment is structurally similar to the spark plug 1 of the first embodiment, except for the structure of an electrical connection part 60*a* in the spark plug 1*a*. More specifically, the electrical connection part 60*a* has a resistor 64 in addition to the first and second conductive seal layers 61 and 62 and the conductor 63 as shown in FIG. 2 in the second embodiment. As the other structures and functions of the spark plug 1*a* are the same as those of the spark plug 1, there will be omitted a detailed explanation of the spark plug 1*a*.

The resistor 64 is formed by e.g. mixing a glass powder such as borosilicate soda glass, a ceramic powder such as $ZrO_2$, a non-metal conductive material powder such as carbon black and/or a metal powder such as Zn (zinc), Sb (antimony), Sn (tin), Ag, Ni etc., and then, firing the resulting resistor composition. As the resistor 64 also performs the noise suppression function, the high-frequency noise suppression effects of the electrical connection part 60*a* can be further improved by the combined use of the conductor 63 and the resistor 64.

In the first and second embodiments, it is feasible to omit either one or both of the first and second conductive seal layers 61 and 62. However, the arrangement of the conductive seal layer 61, 62 allows stronger connection between the conductor 63 (resistor 64) and the center electrode 4 and between the conductor 63 and the metal terminal 5 as the difference in thermal expansion coefficient between the center electrode 4 and the metal terminal 5 can be relieved by the conductive seal layer 61, 62.

In terms of the noise suppression effects, the resistance between the center electrode 4 and the metal terminal 5 (i.e. the resistance of the electrical connection part 60, 60*a*) is preferably in the range of e.g. 3.0 to 20.0 kΩ. This resistance value refers to a value measured with the application of a voltage of 12 V.

B. Formation Method of Electrical Connection Part

FIG. 2 is a flow chart showing one example of formation method of the electrical connection part 60.

At step T110, the raw material powder of the conductor 63 is prepared by mixing and grinding of the conductive material powder of 0.5 to 8.0 μm average particle size and the Fe-containing oxide material powder of 0.5 to 15 μm. At this time, a powder material containing Si, B, P and alkali metal (e.g. a glass powder such as such as borosilicate soda glass or a glass-forming material such as silica sand, soda, limestone, borax etc.) may be added. The mixing and grinding can be done by putting the conductive material powder and the Fe-containing oxide material powder, together with an acetone solvent, an organic binder and a ball of $ZrO_2$, in a resin pot.

At step ST120, the resulting mixed powder is charged into a mold and molded into a cylindrical column shape with the application of a pressure of 30 to 120 MPa.

At step T130, the molded body is fired at 850 to 1350° C. With this, the conductor 63 is obtained.

At step T140, the center electrode 4 is inserted in the through hole 2 of the insulator 3.

At step T150, the seal material powder as the raw material of the first conductive seal layer 61, the conductor 63, the seal material powder as the raw material of the second conductive seal layer 62 are put in this order into the through hole 2 of the insulator 3 from the rear side, and then, compacted by a press pin. In the case where the electrical connection part 60*a* is formed with the resistor 64, the raw material powder of the resistor 64 is put into the through hole 2 of the insulator 3 at step T150.

At step T160, the metal terminal 5 is inserted in the trough hole 2 of the insulator 3. After that, the whole of the insulator 3 is heated and fired at a predetermined temperature of 700 to 950° C. in a furnace while the seal material powder and the conductor are pushed by the metal terminal 5 toward the front within the through hole 2 of the insulator 3. As a result, the first and second conductive seal layers 61 and 62 are sintered so that the conductor 63 (and the resistor 64) is sealed and fixed between these seal layers 61 and 62.

After step T160, the insulator 3 in which the center electrode 4 and the metal terminal 5 have been fixed is secured in the metal shell 7 to which the ground electrode 8 has been joined. Finally, the ground electrode 8 is bent such that the distal end portion of the ground electrode 8 is directed toward the center electrode 4. In this way, the spark plug 1 (1*a*) is completed.

C. Examples

The present invention will be described in more detail below by way of the following examples.

Various samples of the spark plugs 1 and 1*a* (embodiment samples of No. P01 to P23 and comparative example samples of No. P31 to P35) were manufactured and tested for the high-frequency noise suppression effects.

The kind and occupation are rate S1 of the conductive material, the kind and occupation area rate S2 of the Fe-containing material, the area ratio S1/(S1+S2) and compositions (alkali metal content, Cu content and FeO content) of the conductor 63 and the structure of the electrical connection part 60, 60*a* (i.e. the presence or absence of the conductor 63 and the resistor 64) of the respective spark plug samples of No. P01 to P23 (embodiment samples) are shown in TABLE 1A. The kind and occupation are rate S1 of the conductive material, the kind and occupation area rate S2 of the Fe-containing material, the area ratio S1/(S1+S2) and compositions (alkali metal content, Cu content and FeO content) of the conductor 63 and the structure of the electrical connection part 60, 60*a* (i.e. the presence or absence of the conductor 63 and the resistor 64) of the respective spark plug samples of No. P31 to P35 (comparative example samples) are shown in TABLE 1B.

Figure 3:
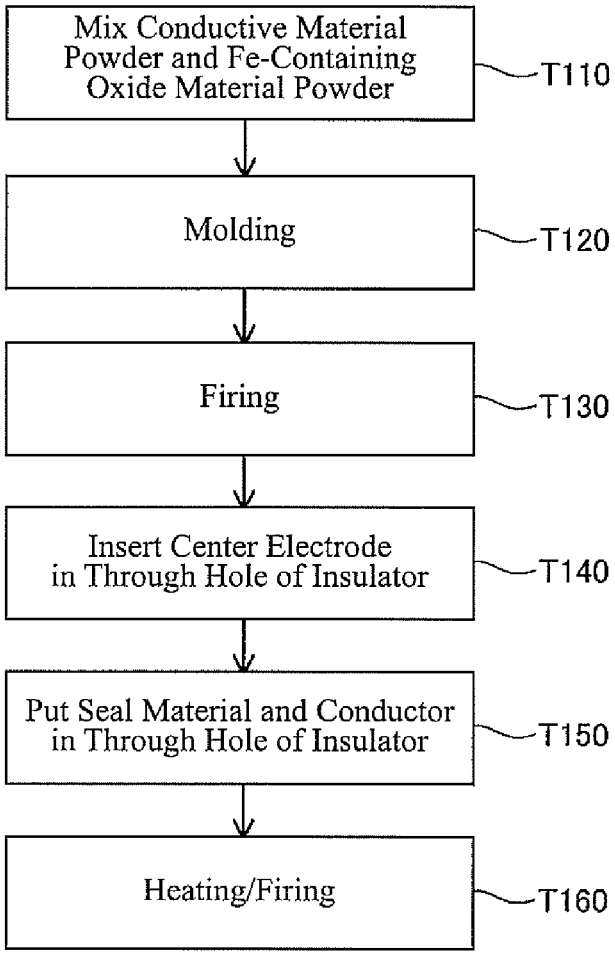
FIG. 3 is a flow chart for a method of forming an electrical connection part in the spark plug according to the first or second embodiment of the present invention.

The occupation area rate S1 of the Fe-containing oxide material, the occupation area rate S2 of the conductive material and the area ratio S1/(S1+S2) were determined as follows. For each of the spark plug samples, the conductor 63 was formed by the process steps T110, T120 and T130 of FIG. 3 and subjected to mirror polishing. A cross section of the conductor 63 along the axis O was observed with an electron probe micro analyzer (EPMA). Backscattered electron images of the cross section of the conductor 63 (10 fields of view of 500 μm×500 μm) were taken. The occupation area rates S1 and S2 of the Fe-containing oxide material and the conductive material was calculated by analysis of the respective images based on the assumption that, in the EPMA analysis, the regions in which Fe (iron) and O (oxygen) were detected were of the Fe-containing oxide material and the regions (except the voids) in which O (oxygen) was undetected were of the conductive material. The area ratio S1/(S1+S2) was calculated from these occupation area rates S1 and S2.

The alkali metal content (wt %) was determined in terms of oxide by taking a pulverized specimen of the conductor 63, performing ICP (inductively coupled plasma) emission spectroscopy analysis 10 times on the pulverized specimen and calculating an average value of the quantification analysis results.

The Cu content (wt %) was determined in terms of divalent Cu oxide by the same method as the alkali metal content.

The presence of FeO was identified by X-ray diffraction and EPMA analysis. As for each of the spark plug samples in which FeO and ferrite were contained in the conductor 63, the presence of FeO and ferrite was identified by XPS (X-ray photoelectron spectroscopy) analysis of a polished surface of the conductor 63. The XPS analysis was performed under the conditions of a voltage of 15 kV, an output of 25 W and a measurement area of 15 μm diameter. The FeO content (wt %) was determined by performing XPS analysis at 20 points on the polished surface of the conductor 63 and calculating an average value of the quantification analysis results.

The plug resistance (kΩ) was determined as the resistance between the center electrode 4 and the metal terminal 5.

Further, the spark plug samples were each provided with either or both of the conductor 63 and the resistor 64. In the right columns of TABLES 1A and 1B, the presence of the conductor 63/resistor 64 is indicated by "○"; and the absence of the conductor 63/resistor 64 is indicated by "X".

TABLE 1A

| Sample No. | Fe-containing oxide material: Kind of material | Fe-containing oxide material: Area rate S2 (%) | Conductive material: Kind of material | Conductive material: Area rate S1 (%) | Area ratio S1/(S1 + S2) |
|---|---|---|---|---|---|
| P01 | FeO | 82.5 | Sendust | 4.9 | 0.06 |
| P02 | FeO, $Fe_2O_3$ | 77.6 | Permalloy | 10.2 | 0.12 |
| P03 | FeO | 52.5 | W powder | 44.5 | 0.46 |
| P04 | FeO | 68.2 | Permalloy | 19.5 | 0.22 |
| P05 | FeO | 92.5 | carbon black | 6.2 | 0.06 |
| P06 | FeO, $Fe_2O_3$ | 75.9 | Fe powder | 11.3 | 0.13 |
| P07 | FeO | 71.6 | TiC | 13.3 | 0.16 |
| P08 | FeO, $Fe_2O_3$ | 65.4 | carbon black | 20.6 | 0.24 |
| P09 | FeO, $Fe_2O_3$ | 71.6 | Fe powder | 7.9 | 0.10 |
| P10 | FeO, $Fe_2O_3$ | 79.5 | carbon black | 6.8 | 0.08 |
| P11 | FeO, $Fe_2O_3$ | 54.6 | TiC | 8.5 | 0.13 |
| P12 | FeO, Mn—Zn ferrite | 75.8 | Fe—Ni alloy | 7.0 | 0.08 |
| P13 | FeO, Ni—Zn ferrite | 79.7 | WC | 7.4 | 0.08 |
| P14 | FeO, $Fe_2O_3$, Mn—Zn ferrite | 74.3 | carbon black | 8.2 | 0.10 |
| P15 | FeO, Mn—Zn ferrite | 73.2 | Ni powder | 9.7 | 0.12 |
| P16 | FeO, Mn—Zn ferrite | 72.8 | ferrosilicon | 8.3 | 0.10 |
| P17 | FeO, Ni—Zn ferrite | 75.9 | Sendust | 6.1 | 0.07 |
| P18 | FeO, Ni—Zn ferrite, Mn—Zn ferrite | 74.4 | carbon fiber | 7.5 | 0.09 |
| P19 | FeO, Ni—Zn ferrite | 75.3 | carbon black | 8.3 | 0.10 |
| P20 | FeO, Mn—Zn ferrite | 74.8 | TiC | 8.2 | 0.10 |
| P21 | FeO, $Fe_2O_3$, Ni—Zn ferrite | 72.2 | Mo powder | 8.5 | 0.10 |
| P22 | FeO, Mn—Zn ferrite | 78.0 | ferrosilicon | 8.3 | 0.10 |
| P23 | FeO, Ni—Zn ferrite | 78.4 | Ni powder | 8.9 | 0.10 |

| Sample No. | Alkaline content (wt %) | Cu content (wt %) | FeO content (wt %) | Plug resistance (kΩ) | Electrical connection part: Conductor | Electrical connection part: Resistor |
|---|---|---|---|---|---|---|
| P01 | 0 | 0 | 100.0 | 21.2 | ○ | X |
| P02 | 0 | 0 | 82.0 | 20.5 | ○ | X |
| P03 | 0 | 0 | 100.0 | 21.5 | ○ | X |
| P04 | 0 | 0 | 100.0 | 21.8 | ○ | X |
| P05 | 0 | 0 | 100.0 | 20.5 | ○ | X |
| P06 | 0.2 | 0 | 35.0 | 22.2 | ○ | X |
| P07 | 0.1 | 0.02 | 100.0 | 21.4 | ○ | X |
| P08 | 6.6 | 0 | 0.7 | 21.9 | ○ | X |
| P09 | 0.5 | 0 | 22.0 | 20.8 | ○ | X |
| P10 | 6.5 | 0.01 | 34.0 | 20.5 | ○ | X |
| P11 | 3.2 | 0 | 39.0 | 20.1 | ○ | X |
| P12 | 0.6 | 0 | 0.8 | 20.3 | ○ | X |
| P13 | 1.2 | 0 | 5.2 | 20.4 | ○ | X |
| P14 | 2.7 | 0 | 4.6 | 20.1 | ○ | X |
| P15 | 5.8 | 0.02 | 4.1 | 20.6 | ○ | X |
| P16 | 6.4 | 0.03 | 3.7 | 20.2 | ○ | X |
| P17 | 4.2 | 5.40 | 3.6 | 20.7 | ○ | X |
| P18 | 3.3 | 0.22 | 2.2 | 21.4 | ○ | X |
| P19 | 3.8 | 0.94 | 1.1 | 21.1 | ○ | X |
| P20 | 4.7 | 3.20 | 1.3 | 3.0 | ○ | ○ |
| P21 | 5.2 | 2.80 | 1.7 | 20.0 | ○ | ○ |
| P22 | 2.1 | 4.90 | 1.8 | 12.7 | ○ | ○ |
| P23 | 1.6 | 1.80 | 2.2 | 7.3 | ○ | ○ |

TABLE 1B

| Sample No. | Fe-containing oxide material: Kind of material | Fe-containing oxide material: Area rate S2 (%) | Conductive material: Kind of material | Conductive material: Area rate S1 (%) | Area ratio S1/(S1 + S2) |
|---|---|---|---|---|---|
| P31 | — | 0 | Sendust | 52.5 | 1.00 |
| P32 | $Fe_3O_4$ | 84.3 | Permalloy | 10.2 | 0.11 |
| P33 | $Fe_2O_3$ | 82.3 | W powder | 28.8 | 0.26 |
| P34 | — | 0 | Fe—Ni alloy | 75.2 | 1.00 |
| P35 | FeO, $Fe_2O_3$ | 77.8 | Ni powder | 4.2 | 0.05 |

| Sample No. | Alkaline content (wt %) | Cu content (wt %) | FeO content (wt %) | Plug resistance (kΩ) | Electrical connection part: Conductor | Electrical connection part: Resistor |
|---|---|---|---|---|---|---|
| P31 | 0 | 0 | 0 | 0.2 | X | ○ |
| P32 | 0 | 0 | 0 | 20.5 | ○ | X |

TABLE 1B-continued

| | | | | | | |
|---|---|---|---|---|---|---|
| P33 | 0 | 0 | 0 | 21.5 | ○ | X |
| P34 | 0 | 0 | 0 | 0.3 | X | ○ |
| P35 | 0 | 0 | 18.0 | ∞ | ○ | ○ |

The high-frequency noise suppression effects of the respective spark plug samples were tested as follows. Each of the spark plug samples was subjected to discharge durability test by allowing the spark plug sample to generate spark discharge for 100 hours with the application of a discharge voltage of 10 kV. The occurrence of high-frequency noise was measured at three frequency levels: 30 MHz, 100 MHz and 200 MHz before and after the discharge durability test according to JASO (Japanese Automotive Standards Organization) D-002-2, "Automobiles —Radio Noise Performance, Section 2, Evaluation of Noise Suppressor by Current Method".

The test results of the respective spark plug samples of No. P01 to P23 (embodiment samples) are shown in TABLE 2A. The test results of the respective spark plug samples of No. P31 to P35 (comparative example samples) are shown in TABLE 2B.

TABLE 2A

| | Noise (dB): before durability test | | | Noise (dB): after durability test | | |
|---|---|---|---|---|---|---|
| Sample No. | 30 MHz | 100 HMz | 200 HMz | 30 MHz | 100 HMz | 200 HMz |
| P01 | 52 | 42 | 35 | 61 | 52 | 45 |
| P02 | 51 | 43 | 36 | 60 | 51 | 46 |
| P03 | 55 | 41 | 35 | 60 | 52 | 45 |
| P04 | 50 | 40 | 37 | 59 | 52 | 47 |
| P05 | 51 | 42 | 36 | 59 | 51 | 46 |
| P06 | 45 | 37 | 31 | 55 | 46 | 40 |
| P07 | 46 | 38 | 30 | 54 | 47 | 41 |
| P08 | 46 | 37 | 31 | 57 | 49 | 44 |
| P09 | 42 | 34 | 27 | 47 | 40 | 34 |
| P10 | 41 | 33 | 26 | 46 | 42 | 33 |
| P11 | 42 | 34 | 27 | 47 | 41 | 33 |
| P12 | 35 | 27 | 20 | 40 | 32 | 25 |
| P13 | 34 | 26 | 21 | 41 | 33 | 24 |
| P14 | 35 | 26 | 21 | 41 | 32 | 24 |
| P15 | 35 | 27 | 21 | 40 | 33 | 24 |
| P16 | 31 | 23 | 17 | 34 | 26 | 20 |
| P17 | 32 | 24 | 16 | 35 | 27 | 20 |
| P18 | 31 | 24 | 18 | 35 | 27 | 21 |
| P19 | 32 | 24 | 17 | 35 | 27 | 21 |
| P20 | 26 | 19 | 11 | 27 | 19 | 12 |
| P21 | 27 | 18 | 12 | 26 | 18 | 12 |
| P22 | 27 | 19 | 11 | 27 | 19 | 11 |
| P23 | 27 | 19 | 11 | 27 | 19 | 11 |

TABLE 2B

| | Noise (dB): before durability test | | | Noise (dB): after durability test | | |
|---|---|---|---|---|---|---|
| Sample No. | 30 MHz | 100 HMz | 200 HMz | 30 MHz | 100 HMz | 200 HMz |
| P31 | 92 | 88 | 83 | 99 | 94 | 90 |
| P32 | 66 | 61 | 57 | 88 | 77 | 70 |
| P33 | 68 | 59 | 56 | 90 | 84 | 79 |
| P34 | 92 | 88 | 81 | 99 | 94 | 88 |
| P35 | — | — | — | — | — | — |

The following verifications were made based on the above test results.

[1] In the embodiment samples of No. P01 to P63, the conductor 63 was formed using the conductive material and the Fe-containing oxide material; and FeO was contained in the Fe-containing oxide material. The respective embodiment samples had a noise level of 55 dB at maximum, which was not excessively high, before the discharge durability test. It was possible to attain sufficient noise suppression effects before the discharge durability test. After the discharge durability test, there was seen not much increase in the noise level of the respective embodiment samples. It was possible to maintain the sufficient noise suppression effects even after the discharge durability test.

Further, the area ratio S1/(S1+S2) of the conductor 63 was in the range of 0.06 to 0.46 in each of the respective embodiment samples. When the area ratio S1/(S1+S2) was in this range, it was possible to prevent the resistance of the conductor from becoming too high while securing the sufficient noise suppression function of the Fe-containing oxide material. It has been shown by the test results that the area ratio S1/(S1+S2) of the conductor 63 is more preferably in the range of 0.07 to 0.24, still more preferably 0.08 to 0.11.

[2] In the comparative example samples of No. P31 and P34, the conductor 63 was not provided in the electrical connection part 60. These comparative example samples had a high noise level of 80 dB or lower and failed to show sufficient noise suppression effects.

By contrast, the conductor 63 was provided in the electrical connection part 60 in the comparative example samples of No. P32 and P33. There was however seen unfavorable increase in the noise level of these comparative example samples after the discharge durability test. The reason for this is assumed that, in the absence of FeO in the conductor 63, the noise suppression function of the Fe-containing oxide material deteriorated due to reduction of $Fe_2O_3$ to FeO when the electrical connection part 60 reached a high temperature during the discharge durability test.

Moreover, the comparative example samples of P32, P33 and P35 were unfavorable in that the plug resistance of the respective comparative example samples exceeded 20 kΩ. In particular, the plug resistance of the comparative example sample P35 was infinite. The reason for this is assumed that the plug resistance was excessively increased as the area ratio S1/(S1+S2) of the conductor 63 was too small. It can be thus said that the area ratio S1/(S1+S2) of the conductor 63 is preferably greater than or equal to 0.6.

[3] Among the embodiment samples, the alkali metal was contained in the conductor 63 in the samples of No. P06 to P26. The presence of Si (silicon), B (boron) and P (phosphorous) in the conductor 63 was also confirmed in these samples of No. P06 to P26. On the other hand, the alkali metal was not contained in the conductor 63 in the samples of No. P01 to P05. The samples of No. P06 to P26 were preferred to the samples of No. P01 to P05, in that the noise level of the samples of No. P06 to P26 before the discharge durability test was lower than that of the samples of No. P01 to P05. The reason for this is assumed that the alkali metal, Si, B and P were contained as constituent elements of glass in the conductor 63. The noise suppression effects were improved as the conductor 63 was closely packed by filling the voids of the conductor 63 with the glass.

[4] In the samples of No. P09 to P23, the alkali metal content of the conductor 63 was in the rage of 0.5 to 6.5 wt %

(in terms of oxide). On the other hand, the alkali metal content of the conductor 63 was in the rage of 0.2 to 6.6 wt % (in terms of oxide) in the samples of No. P06 to P08. Due to such difference, the noise level of the samples of No. P09 to P23 was favorably lower than that of the samples of No. P06 to P08. It has been shown by the test results that the alkali metal content of the conductor 63 is more preferably in the range of 1.1 to 3.7 wt %, still more preferably 1.3 to 2.2 wt %.

[5] In the samples of No. P12 to P23, the ferrite was contained in the Fe-containing oxide material. Further, the FeO content of the Fe-containing oxide material was in the range of 0.8 to 5.2 wt % (in terms of oxide) in these samples of No. P12 to P23. On the other hand, the ferrite was not contained in the Fe-containing oxide material in the samples of No. P01 to P11. The samples of No. P12 to P23 were preferred to the samples of No. P01 to P11, in that the noise level of the samples of No. P12 to P23 was lower than that of the samples of No. P01 to P11. The reason for this is assumed that: the Fe-containing oxide material was prevented from degradation over time by controlling the FeO content to be 0.8 wt % or higher; and the sufficient noise suppression function of the ferrite was secured by controlling the FeO content to be 5.2 wt % or lower. It has been shown by the test results that the FeO content of the Fe-containing material is more preferably in the range of 1.1 to 3.7 wt %, still more preferably 1.3 to 2.2 wt %.

[6] In the samples of No. P16 to P23, the Cu content of the conductor 63 was in the range of 0.03 to 5.4 wt % (in terms of divalent Cu oxide). The Cu content of the conductor 62 was out of such a content range in the samples of No. P01 to P15. The samples of No. P16 to P23 were preferred to the samples of No. P01 to P15, in that the noise level of the samples of No. P16 to P23 was lower than that of the samples of No. P01 to P15. It has been shown by the test results that the Cu content of the conductor 63 is more preferably in the range of 1.8 to 4.9 wt %.

[7] Among all of the embodiment samples, the samples of No. P20 to P23 had a particularly low noise level. Even after the discharge durability test, there was seen almost no increase in the noise level of the samples of No. P20 to P23. For these reasons, the samples of No. P20 to P23 were most preferred. In view of the test results of these samples of No. P20 to P23, the combination of the most preferred parameter ranges is as follows.

(1) Area ratio S1/(S1+S2) of Fe-containing oxide material: 0.08 to 0.11

(2) Alkali metal content of resistor 63: 1.6 to 5.2 wt % (in terms of oxide)

(3) Cu content of resistor 63: 1.8 to 4.9 wt % (in terms of divalent Cu oxide)

(4) FeO content of Fe-containing oxide material: 1.3 to 2.2 wt %

(5) Plug Resistance: 3.0 to 20 kΩ.

The entire contents of Japanese Patent Application No. 2014-098322 (filed on May 12, 2014) are herein incorporated by reference.

The present invention is not limited to the above specific embodiment and modification examples and can be embodied in various forms without departing from the scope of the present invention. For example, the present invention is applicable to any type of spark plug other than those shown in FIGS. 1 and 2. The scope of the invention is defined with reference to the following claims.

Having described the invention, the following is claimed:

1. A spark plug comprising:

an insulator having a through hole formed therein in a direction of an axis;

a center electrode disposed in a front side of the through hole;

a metal terminal disposed in a rear side of the through hole;

an electrical connection part arranged in the through hole to establish electrical connection between the center electrode and the metal terminal; and a metal shell holding therein the insulator, wherein the electrical connection part has a conductor including a conductive material and at least one kind of Fe-containing oxide material;

wherein the Fe-containing oxide material contains at least FeO; and wherein the conductor satisfies a relationship of $0.06 \leq S1/(S1+S2) \leq 0.46$ where, in a cross section taken along the axis, S1 is an area occupied by the conductive material; and S2 is an area occupied by the Fe-containing oxide material.

2. The spark plug according to claim 1, wherein the conductor further includes an alkaline-containing phase that contains an oxide of an alkali metal and an oxide of at least one kind of element selected from the group consisting of Si, B and P.

3. The spark plug according to claim 2, wherein the alkali metal is contained in an amount of 0.5 to 6.5 wt % in terms of oxide based on the conductor.

4. The spark plug according to claim 1, wherein the Fe-containing oxide material further contains a ferrite.

5. The spark plug according to claim 4, wherein the FeO is contained in an amount of 0.8 to 5.2 wt % based on the Fe-containing oxide material.

6. The spark plug according to claim 1, wherein the conductor further includes Cu in an amount of 0.03 to 5.4 wt % in terms of divalent Cu oxide.

7. The spark plug according to claim 1, wherein the electrical connection part has a resistor including a conductive material and a glass material, a first conductive seal layer located adjacent to the center electrode and a second conductive seal layer located adjacent to the metal terminal;

wherein the conductor and the resistor are arranged between the first and second conductive seal layers; and wherein a resistance between the center electrode and the metal terminal is in a range of 3 to 20 kΩ.

* * * * *